US006068666A

United States Patent [19]

Amick et al.

[11] Patent Number: 6,068,666

[45] Date of Patent: May 30, 2000

[54] BLENDED FIBER GARMENT OVER DYEING PROCESS

[75] Inventors: Robert Amick, Roanoke; James I. Brebner, Lynchburg, both of Va.

[73] Assignee: Performance Apparel, LLC, Norfolk, Va.

[21] Appl. No.: 09/030,501

[22] Filed: Feb. 25, 1998

[51] Int. Cl.[7] ..... D06P 3/87

[52] U.S. Cl. ..... 8/441; 8/491; 8/529; 8/532; 8/650; 8/934

[58] Field of Search ..... 8/441, 491, 494, 8/529, 532, 650, 934

[56] References Cited

U.S. PATENT DOCUMENTS

| | | | |
|---|---|---|---|
| 3,576,589 | 4/1971 | Coon | 8/532 |
| 3,617,168 | 11/1971 | Mack | 8/532 |
| 3,723,055 | 3/1973 | Hooper et al. . | |
| 4,283,194 | 8/1981 | Teague et al. | 8/494 |
| 4,756,037 | 7/1988 | McFadyen et al. . | |
| 4,801,303 | 1/1989 | Carlough et al. | 8/532 |
| 4,845,789 | 7/1989 | Morton et al. . | |
| 4,902,300 | 2/1990 | Johnson et al. | 8/532 |
| 5,477,595 | 12/1995 | Wiengarten et al. . | |
| 5,482,516 | 1/1996 | Sheppard . | |
| 5,515,699 | 5/1996 | Weingarten et al. . | |
| 5,527,361 | 6/1996 | Sheppard . | |

*Primary Examiner*—Caroline D. Liott
*Attorney, Agent, or Firm*—John F. Carroll, IV; Kimberly A. Chasteen

[57] ABSTRACT

Textiles are first manufactured to attain dimensional stability and durability and thereby withstand the rigors of industrial rental and commercial laundering. Then, the garments are dyed in a two-stage process to yield outstanding colorfastness, pilling resistance, dimensional stability and durability. Garments are yielded that, even after extensive use, may be overdyed to custom colors in custom-sized batches to extend the useful life of stained or otherwise discolored garments. By performing the dyeing and/or over-dyeing portions of the process at a location near the end user of the textile, transaction costs related to transportation of goods are minimized, technical resources are efficiently utilized, and large inventories of dyed garments need not be maintained, thereby reducing inventory expenses. Knit garments are formed by selecting synthetic polymeric and cellulosic fibers, spinning fibers into yarn, knitting yarn into fabric, treating the fabric, cutting and sewing the fabric into garments, dyeing the cellulosic fiber portion of the garments, and dyeing the synthetic polymeric fiber portion of the garments at temperatures and pressures above atmospheric conditions. Integrated with several of these steps are reiterative processes, including a pattern-making step by which dimensional shrinkage is predicted and controlled, and a dye formulation step by which custom colors can be imparted to the sewn garment.

5 Claims, 3 Drawing Sheets

BLENDED FIBER GARMENT OVER DYEING PROCESS

BACKGROUND

Figure 1:
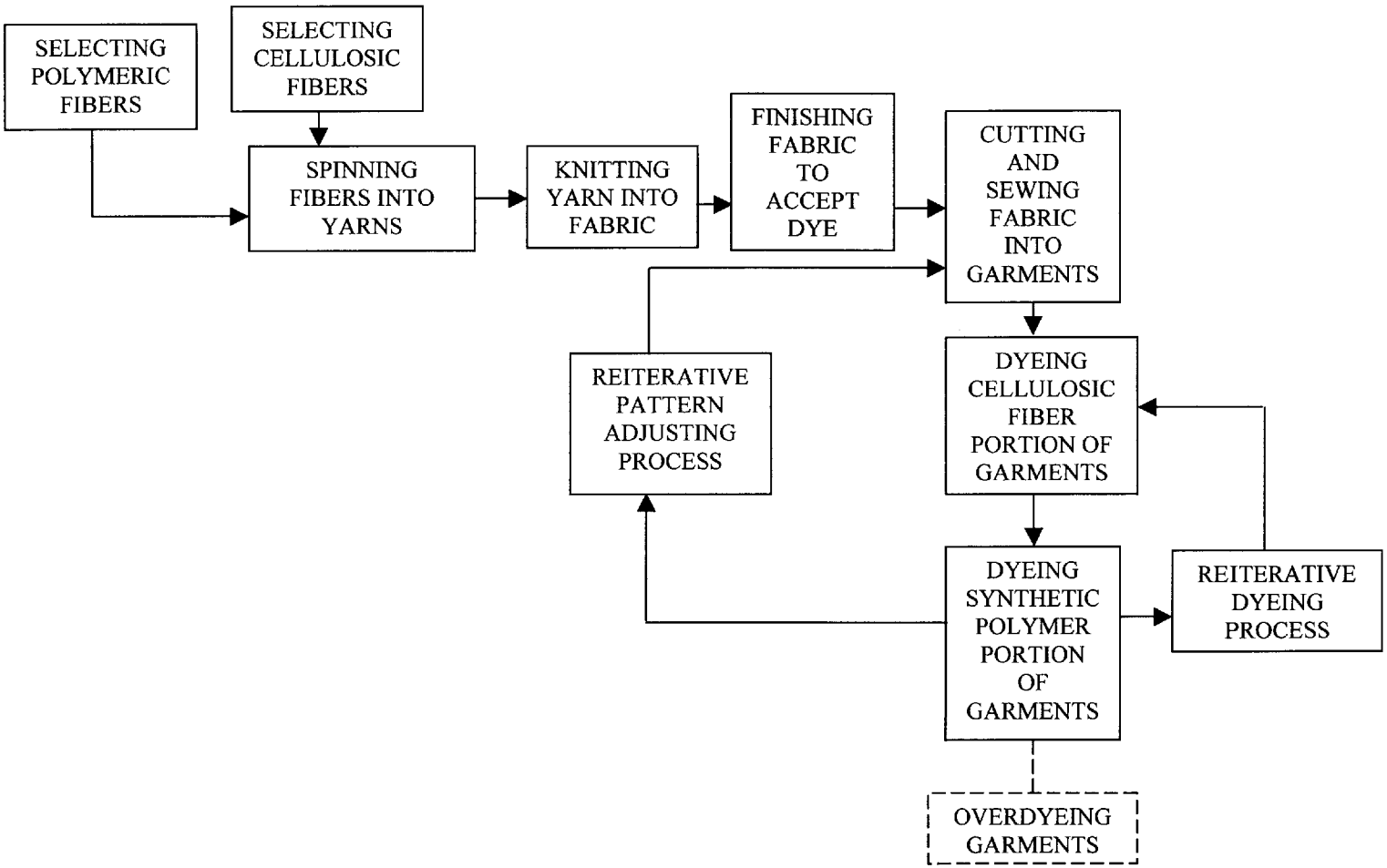

The present invention relates to a blended-fiber, knit garment and a process for designing and dyeing polyester-cotton, knit garments with soil-release characteristics, colorfastness, durability, shrinkfastness and anti-pilling properties in order to meet the diverse demands of the commercial laundering and industrial rental markets. The invention conveys these benefits without the application of resins that are known to have limited effectiveness and cause loss of cellulosic tensile strength. Additionally, the invention economically maximizes the cost of transporting finished garments, eliminates the production of unwanted dyed scrap fabric and significantly reduces wastewater that is otherwise commonly associated with garment dyeing processes.

Knit garments are naturally more comfortable than woven garments, and knits also provide an aesthetically pleasing appearance, making knits highly desired for industrial uniform rental applications. However, the processes by which knit garments are presently manufactured causes them inherently to lack stability, durability and fastness, making knits unsuitable for rental applications and commercial laundering attendant thereto. Knit garments are cut and sewn from fabric that is manufactured by one of two processes: either yarn dyeing or fabric dyeing. Yarn dyeing involves first spinning fibers into yarn, winding the yarn into skeins and then placing the wound skeins onto dyeing cones. The cones are immersed into liquor and dyed. The dyed yarn is then knitted into fabric, usually in tubular form. In fabric dyeing, the yam is first spun and knit into fabric in a tubular shape and stored on a take-up roll. The tubular-knit fabric is then pulled through a water jet nozzle while being impregnated with dye.

Whether yam-dyed or fabric-dyed, the resulting fabric is then passed through a finishing procedure that attempts to minimize staining from different types of soil, reduce wrinkling during washing and drying, improve shrinkage resistance, provide softness for better hand and reduced needle cutting during the garment sewing process. This finishing process is performed by supporting the fabric on a tenter frame and treating the fabric with resin. Unfortunately, application of resin imparts only partial shrinkage control, and the effectiveness of the resin to impart soil release characteristics decreases when the fabric is exposed to chemicals used in commercial laundering. Additionally, the application of resin to cotton-polyester blended fabric causes a significant decrease in the tensile strength of the cellulosic component of the textile, thereby decreasing the durability and serviceable life of knit garments. As a result, there is a need for knits that can acquire good soil release characteristics, shrinkage resistance and softness without the addition of resin.

In addition to the shortcomings imposed by resin treatment, yarn and fabric dyeing processes employed in the textile industry waste dye, chemicals and water. In both yam dyeing and fabric dyeing, the dyeing processes must be performed before the garment is cut and sewn. As a result, a significant amount of dyed fabric is wasted when the unneeded fabric scraps are discarded after the cutting portion of the respective processes. In addition to the lost dye contained in the unneeded scraps, the discarded, dyed fabric represents increased production of wastewater as well as the loss of otherwise unneeded chemicals in the dyeing process and the loss of dyeing capacity that was unnecessarily consumed in dyeing the wasted scraps.

In addition to losses associated with dyeing unnecessary portions of textiles, the economics associated with transportation in the garment industry causes inefficiencies to be introduced in the manufacture of knit garments. Cutting and sewing is the most labor intensive portion of the garment manufacturing process. However, certain dyeing processes, such as custom dyeing, involves only modest amounts of labor and is highly technical. As a result, manufacturers of knit garments transport their undyed spun yam or undyed fabric from the location of manufacture, which typically has widely available labor, to a location for dyeing that has adequate technical and equipment resources. After dyeing, the goods are shipped back to regions of available labor for knitting and/or cutting and sewing before final shipment to a finished garment distribution network. This is a lengthy process. Consequently, large stores of dyed garments must be maintained in order to readily supply any demands. The costs attendant to maintaining such an inventory can be high. Additionally, the transaction costs associated with the transportation of goods can exceed the value of the materials in the finished garments, making custom dyeing impractical. Consequently, there is a need in the industry for both a garment and a process by which such a garment can be manufactured that will maximize the efficient use of available resources, including inventory management and transportation resources.

In addition to streamlining the utilization of resources, there is a need to improve the chemical processes by which knits are dyed so as to better serve the needs of the commercial laundering and industrial rental markets. Yarn dyed and fabric dyed knit garments shrink by five percent (5%) or more in width and greater than ten percent (10%) in length when exposed to commercial laundering. Length-to-width shrinkage can be so disproportionate that threads break and seams pucker. In addition, yarn dyeing is inefficient. In yarn dyeing, the outer surface of fibers may appear to be dyed; however, the inner portion of each fiber remains undyed. This is known as the "ring-dye effect." When combined with the poor colorfastness of dyes typically utilized in yarn dyeing, garments made of yarn-dyed fibers wear prematurely with industrial use and commercial laundering. While the chemistry of fabric dyeing can produce textiles with better washfastness than can yam dyeing, fabric dyeing is very difficult to execute properly. Consequently, in addition to the aforesaid, there is a need in the industry for a garment and a process of designing and dyeing a knit textile to render it capable of maintaining dimensional stability, durability, colorfastness, and pill resistance when exposed to the harsh environments imposed by commercial laundering and industrial rental.

SUMMARY

The present invention is directed toward a process for inventory management, a process for manufacturing a garment, a garment itself, and a process for overdyeing a garment. Each of these are performed so that the resulting textile that has good colorfastness, dimensional stability, pill resistance and durability in commercial laundering and in industrial uniform rental. Furthermore, the invention maximizes the efficient utilization of inventory, technological and transportation resources.

The invention is a process for inventory management of dyed, blended-fiber, knit garments that has several steps. First, blended-fiber, knit garments are acquired that have been manufactured to allow shrinkage from vat dyeing at atmospheric conditions and shrinkage from disperse dyeing at temperatures and pressures above atmospheric conditions.

Then, as dyed garments may be needed, they are vat dyed at atmospheric conditions and then disperse dyed at temperatures and pressures above atmospheric conditions.

The invention is also a process for manufacturing a resin-free, dyed, blended-fiber, knit garment with shrink resistance. This process has several steps, which include the following. A blended-fiber, knit garment is manufactured to allow for shrinkage from vat dyeing at atmospheric conditions and disperse dyeing at temperatures and pressures above atmospheric conditions. The blended-fiber, knit garment is vat dyed at atmospheric conditions and disperse dyed at temperatures and pressures above atmospheric conditions.

The invention is also a dyed, resin-free, shrink-resistant knit garment, prepared by a particular process that has several steps, including the following. A knit garment is manufactured to allow for shrinkage from vat dyeing at atmospheric conditions and disperse dyeing at temperatures and pressures above atmospheric conditions. The knit garment is vat dyed at atmospheric conditions and disperse dyed at temperatures and pressures above atmospheric conditions.

The invention is also a process for overdyeing a previously-dyed, blended-fiber, knit garment that has the following steps. A blended-fiber, knit garment is acquired that has been manufactured to allow for shrinkage from vat dyeing at atmospheric conditions and from disperse dyeing at temperatures and pressures above atmospheric conditions. Additionally, the garment has been previously vat-dyed at atmospheric conditions and disperse-dyed at temperatures and pressures above atmospheric conditions. The garment is vat dyed at atmospheric conditions and disperse dyed at temperatures and pressures above atmospheric conditions.

These and other aspects of the present invention will become apparent to those skilled in the art after reading the following description.

DESCRIPTION

According to the present invention, textiles are first manufactured to attain dimensional stability and durability and thereby withstand the rigors of industrial rental and commercial laundering. Then, as described herein, the garments are dyed in a two-stage process to yield outstanding colorfastness, pilling resistance, dimensional stability and durability. The garment manufacturing process and the dyeing processes complement each other to virtually eliminate further shrinkage in the dyed garment. The placement of the dyeing steps after the fabric cutting and sewing steps also conserves dye and dyeing-related chemicals as well as reduces wastewater. Additionally, the process of the invention yields garments that, even after extensive use, may be overdyed to custom colors in custom-sized batches to extend the useful life of stained or otherwise discolored garments. By performing the dyeing and/or over-dyeing portions of the process at a location near the end user of the textile, transaction costs related to transportation of goods are minimized, and technical and equipment resources are efficiently utilized. Furthermore, large inventories of dyed garments need not be maintained. Instead, the invention allows an inventory of undyed garments to be maintained from which custom-dyed garments may readily be manufactured and supplied to purchasers. This significantly reduces inventory expenses.

The process of the present invention as applied to knit garments is shown in FIG. 1 and may be described by selecting synthetic polymeric and cellulosic fibers, spinning fibers into yarn, knitting yarn into fabric, finishing fabric to accept dye, cutting and sewing the fabric into garments, dyeing the cellulosic fiber portion of the garments, and dyeing the synthetic polymeric fiber portion of the garments. Integrated with several of these steps are reiterative processes, including a pattern-making step by which dimensional shrinkage is predicted and controlled, and a dye formulation step by which custom colors can be imparted to the sewn garment. A more detailed description of these steps follows.

Synthetic polymeric and cellulosic fibers are selected to impart the greatest durability, wickability, breatheability and dimensional stability to the finished garment. After the synthetic polymeric fibers and the cellulosic fibers have been selected, they are spun into yarn. The spinning process must be closely monitored to provide proper shrink control to the cotton component of the yarn. The yarn is then heat treated to control the shrinkage of the synthetic fiber. The shrinkage control imparted to the cellulosic components and the synthetic components of the yarn should be closely regulated to properly mate proportional shrinkage between the two fibers. The yarn is then knitted, typically in tubular form. Following knitting, the fabric is treated to remove knitting oils, pre-shrink the fabric and allow for proper dye penetration. This finishing may be performed by the use of emulsifiers, caustics, surfactants and wetting agents in various combinations to achieve the desired effect. The fabric is then softened to give the fabric good hand and facilitate its spreading and cutting and to reduce needle cutting tears caused by dull needles moving on high-speed sewing machines. The fabric softener is typically a non-ionic polyethylene with wax emulsions added. After the softening step, the fabric is spread and cut by industrial cutting saws. Knit garments can be made directly from tubular knit fabric. However, garments made in this fashion tend to torque when exposed to commercial laundering. Therefore, side seam construction can be used. In the cutting and sewing step, fabric is rolled into many ply and cut according to patterns and then sewn. Then, prior to dyeing, the sewn garments are either bleached white or, for garments that will be a dark shade, given a light scour to remove knitting oil.

The cutting and sewing process is critical to the successful performance of a garment designed to withstand the rigors of commercial laundering and industrial rental. Although some shrinkage resistance can be instilled in the yarn as described herein, cellulosic fibers have natural inconsistencies that are difficult to gauge, particularly from harvest to harvest. At least annually, therefore, manufacturers will gradually merge new supplies of cellulosic fiber into existing supplies so that dramatic shifts in product performance will not occur. However, because of the variable natures of the constituent fibers, the patterns for knit garments should be adjusted to compensate for these variations at least annually, if not on a more regular basis.

One iterative method of adjusting patterns is described as follows. First, test pieces are assembled from fabric, such as tubular knit fabric. Then an indelible ink grid is imprinted on the test pieces. The test pieces are then dyed and subjected to commercial laundering. The dimensions of the grid, or "markers", imprinted on the test pieces can be compared with the dimensions of the grid on control test pieces which have not been dyed or laundered. Shrinkage in width from about one-half percent (0.5%) to about one percent (1%) is generally acceptable, and shrinkage in length from about six percent (6%) to about eight percent (8%) is generally acceptable. Shrinkage in length in excess of ten percent (10%) is generally unacceptable. Should the shrinkage of the test pieces be excessive, the pattern should be adjusted to compensate for shrinkage in that direction. This process can be repeated until acceptable shrinkage is attained in the dyeing process. In addition to testing and compensating for variable shrinkage of fabric fibers, sewing thread and sewing thread tensions should be selected so that the thread sewn into the garments shrinks at rate that is similar to the shrinkage rate of the fabric. Mismatches between shrinkage rates of thread and fabric can result in either puckering of seams or breakage of thread.

After the fabric is cut and sewn into garments in the described manner so as to take into account the variabilities of fabric and thread shrinkage, the garments are dyed by immersion in dyestuffs. For atmospheric dyeing, dyes should be selected as are appropriate for application to the fiber sought to be dyed. Although vat dyes are unpopular because they are difficult to use, vat dyes perform well with this embodiment of the invention and produce satisfactory results because of their ability to render good fastness to cellulosic fibers. In addition, the chemistry of vat dyes is more suited to rotary dye equipment than other types of dyeing equipment, including jet dyeing and yarn dyeing equipment.

Figure 2:
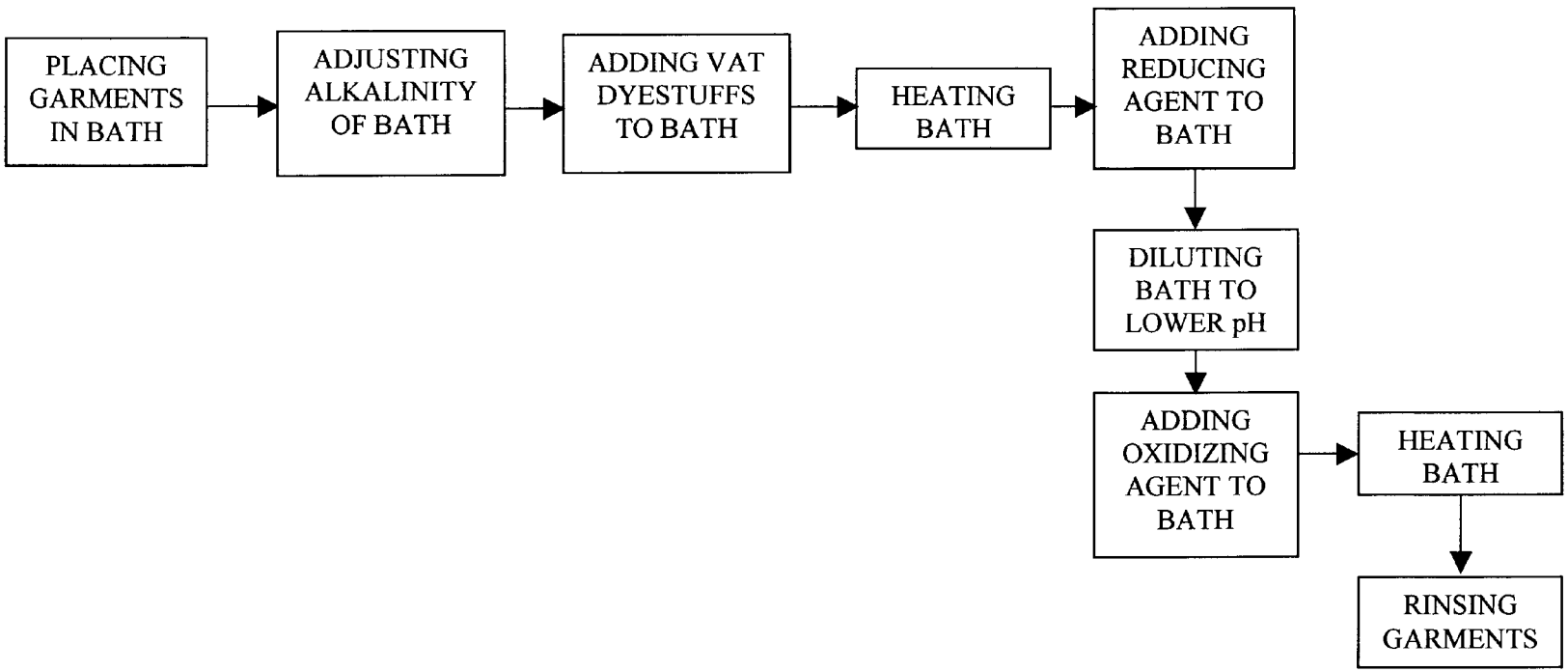

The dyeing of the cellulosic component of the garment can be carried out as shown in FIG. 2 at approximately atmospheric conditions as follows. An atmospheric vessel is still filled with cold water at approximately ninety degrees Fahrenheit (90° F.) to form a bath with a liquor ratio of approximately 15:1, i.e., fifteen (15) parts water to one (1) part garment, by weight. A caustic agent such as sodium hydroxide is slowly added to the bath to bring the bath to a pH in a range from about twelve and one-half (12.5 pH) to about thirteen and one-half (13.5 pH), with a pH of about thirteen (13 pH) yielding satisfactory results. The bath is then agitated. The agitation can occur by rotation of the vessel about a horizontal axis at approximately twelve revolutions per minute (12 rpm) for approximately five minutes (5 min). Dyestuffs are then slowly added to the bath. The period of time over which dyestuffs are added to the bath can be about five minutes (5 min). Agitation is continued and the bath is heated indirectly at approximately four degrees Fahrenheit per minute (4° F./min) until the bath reaches a temperature of approximately one hundred and forty degrees Fahrenheit (140° F.). A reducing agent such as sodium hydrosulfite is then added to the bath to hold the dye in the reduced, or leuco, state while agitation is maintained. Alternatively, a combination of nitrogen gas and sodium hydrosulfite can be added to the bath to achieve reduction. Addition of nitrogen gas to a pressure vessel with modest seals and a bellows-operated gas overflow system can stabilize the available hydrosulfite, thereby significantly decreasing the amount of sodium hydrosulfite needed to stabilize the reaction. Use of nitrogen to reduce sodium hydrosulfite consumption decreases the cost of dyeing and increases the quality of any wastewater produced.

Following the addition of the reducing agent, agitation is continued and the temperature of the bath is maintained at approximately one hundred and forty degrees Fahrenheit (140° F.) for a period of time ranging from about ten minutes (10 min) to about thirty minutes (30 min), depending on the depth of shade desired. Water is then added to the bath, and excess bath is drained to maintain an approximately constant bath volume until the pH of the bath is reduced to about ten (10 pH) or lower. Then, at a pH of approximately ten (10 pH) or less, the liquor ratio is decreased from about twenty-to-one (20:1) to about eight-to-one (8:1). After the liquor ratio of the bath is decreased in such a manner, an oxidizing agent can be added to the bath to react with the dyestuffs. The oxidizing agent can be thirty-five percent (35%) hydrogen peroxide added at approximately two percent on the weight of the goods (2% O.W.G.). Enough oxidizing agent is added to the bath to fully oxidize the dyestuffs. The bath is then heated indirectly to about one hundred and twenty degrees Fahrenheit (120° F.) at a rate of about five degrees Fahrenheit per minute (5° F./min). The vessel is then rotated at about twelve revolutions per minute (12 rpm) for about ten minutes (10 min). The bath is then drained and the vessel is still filled with warm water at approximately one hundred degrees Fahrenheit (100° F.). The garments are rinsed by rotating the vessel for two minutes (2 min) at twelve revolutions per minute (12 rpm). The vessel can then be rotated for two minutes (2 min) at approximately twelve revolutions per minute (12 rpm). The garments can then be extracted and dried. Yarn dyeing or fabric dyeing of cellulosic fiber textiles can take two or three times longer than the vat dyeing process described above.

Figure 3:
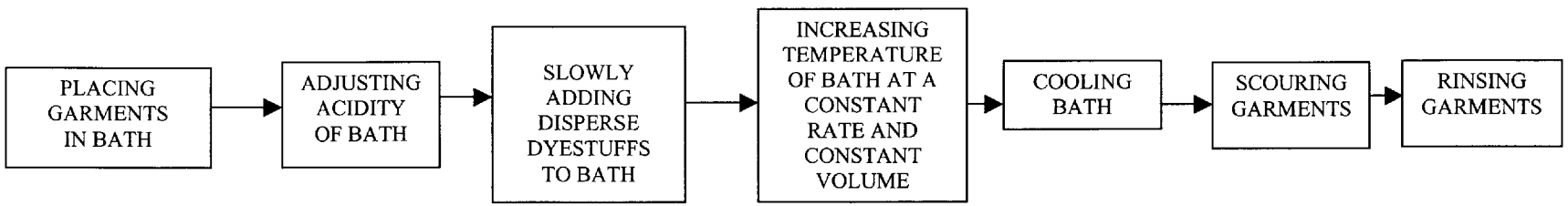

The synthetic fiber portion of knit garments is then dyed as shown in FIG. 3. Blended fiber garments, such as 65/35 or 50/50 polyester and cotton blends, are placed in a pressure vessel and the vessel is still filled with warm water at approximately one hundred degrees Fahrenheit (100° F.), creating a bath with a liquor ratio at approximately 15:1, i.e., fifteen (15) parts hot water to one (1) part garment, by weight. The bath is then agitated by rotating the vessel at approximately twelve revolutions per minute (12 rpm) while leveling agent is added to the bath. The leveling agent assists in controlling the dye strike, allowing for level transfer of dye from the bath into the garment. One such leveling agent is DDP from Southeastern Chemical of Graham, N.C. Additional agents can be added to impart soil release characteristics and increased wickability to the garments. One such agent is ULTRACAP, also from Southeastern Chemical of Graham, N.C.

After the addition of agents, the pH of the bath is adjusted within a range from about four (4 pH) to about five (5 pH), with a bath pH of approximately four and one-half (4.5 pH) yielding favorable results. Acetic acid can be used to adjust the pH. The adjusted bath, complete with leveling agent, is thoroughly mixed. The mixing can occur by rotating the vessel at approximately twelve revolutions per minute (12 rpm) for approximately five minutes (5 min). Dyes are then slowly added to the bath. The dyes can be those available to best dye the fiber desired to be dyed, and for polyesters, can include disperse dyes. The dye bath is then held at constant volume and heated at a predetermined rate. The predetermined rate can be in the range of about three degrees Fahrenheit per minute (3° F./min) to about five degrees Fahrenheit per minute (5° F./min). A rate of approximately four degrees Fahrenheit per minute (40° F./min) can yield satisfactory results. This rate of temperature increase is maintained until the dye bath reaches a temperature of approximately two hundred and sixty-five degrees Fahrenheit (265° F.) and the vessel reaches an internal, relative pressure of about twenty-five pounds per square inch (25 psi). The dye bath can be heated indirectly, by means of a heat exchanger. The temperature and pressure are maintained approximately constant for a significant period of time. For example, this period of time can be about thirty minutes (30 min), but will vary depending on the final shade desired. A longer hold time will produce darker colors and a shorter hold time will produce lighter colors. The elevated temperatures and pressures cause the dye to fully migrate across the cross-sectional diameter of the synthetic fibers. This reduces the ring-dye effect described herein and commonly known in the industry whereby the dye migrates merely into the periphery of the fiber.

The bath is then indirectly cooled via a heat exchanger to approximately one hundred and sixty degrees Fahrenheit (160° F). Indirect cooling is desired because direct injection of cold water has a tendency to shock the fiber and set wrinkles in the garments. Following cooling, the vessel is drained. The vessel can then be still filled with hot water and rinsed by rotating the vessel for two minutes (2 min) at twelve revolutions per minute (12 rpm). One percent (1%) scouring agent is then added to the bath, the bath is heated to approximately one hundred and sixty degrees Fahrenheit (160° F.) and held a that temperature for about five minutes. The vessel can then be drained again and still filled with warm water at approximately one hundred degrees Fahrenheit (100° F). The garments can be rinsed by rotating the vessel for two minutes (2 min) at twelve revolutions per minute (12 rpm). The vessel is drained and the garments can be removed from the pressure vessel and dried.

The present invention can more completely be understood after a review of the following example.

EXAMPLE

Assume the following. Test runs for dyeing garments were conducted in a pressure vessel and an atmospheric vessel under the conditions described below. Two hundred pounds (200 lbs) of undyed, bleached knit shirts were placed in an atmospheric vessel. Prior to dyeing, a light scour was performed to remove excess knitting oils from the shirts. The scour comprised two percent (2%) soda ash and two percent (2%) SANDOPURE RSK from Clariant Corp. of Charlotte, N.C. which were agitated along with the textiles at one hundred and sixty degrees Fahrenheit (160° F.) for five minutes (5 min). The garments were then subjected to a warm rinse. The vessel was still filled with three thousand pounds (3,000 lbs) of cold water at a temperature of ninety degrees Fahrenheit (90° F.). An optional anti-oxidizing agent, OXYGUARD, from Southeastern Chemical of Graham, N.C., was added to the bath to reduce unwanted oxidation of metallic portions of the garments. Eighteen grams per liter (18 g/l) of caustic soda were then added to the bath to adjust the pH, which in this example was fifty-three and 97/100 pounds (53.97 lb) of caustic soda. The caustic soda was fifty percent (50%) strength, in liquid form, and diluted with approximately five gallons (5 gal) of water prior to being mixed with the bath. To achieve a navy color the following vat dyes were then slowly added to the bath: 1.2800% O.W.G. of C.I. Vat Black 27, 5.300% O.W.G. of C.I. Vat Black 16, and 0.1800% O.W.G. of C.I. Vat Green 3. The bath was then heated to one hundred and forty degrees Fahrenheit (140° F.) at a rate of four degrees Fahrenheit per minute (4° F./min). Twelve grams per liter (12 g/l) of hydrosulfite were then added to the bath, which for the purposes of this example was thirty-five and 98/100 pounds (35.98 lb) of hydrosulfite. The bath was held at this temperature for twenty minutes (20 min) while the vessel was rotated at twelve revolutions per minute (12 rpm).

While an approximately constant volume was maintained, water was added to the bath and the diluted bath was drained until thepH of the bath was below approximately ten (10 pH). Then, the liquor ratio was decreased from about twenty-to-one (20:1) to about eight-to-one (8:1). After the liquor ratio of the bath was decreased, two percent on the weight of the goods (2% O.W.G.) of thirty-five percent (35%) hydrogen peroxide was added to the bath to fully oxidize the dyestuffs. The bath was then heated indirectly to about one hundred and twenty degrees Fahrenheit (120° F.) at a rate of about five degrees Fahrenheit per minute (5° F./min). The vessel was then rotated at about twelve revolutions per minute (12 rpm) for about ten minutes (10 min). The bath was then drained and the vessel was still filled with warm water at approximately one hundred degrees Fahrenheit (100° F.). The garments were then rinsed by rotating the vessel for two minutes (2 min) at twelve revolutions per minute (12 rpm). The vessel was then drained, and the shirts were de-watered and extracted.

The garments were then transferred to a pressure vessel. Three thousand pounds (3,000 lbs) of hot water, at a temperature of one hundred and twenty degrees Fahrenheit (120° F.), were added to the vessel. The vessel was then rotated at twelve revolutions per minute (12 rpm) while SECCO DDP leveling agent from Southeastern Chemical of Graham, N.C. was added to the bath. The amount of leveling agent added was one percent on the weight of the goods (1% O.W.G.), which in this particular example was a total of two pounds (2 lbs) of leveling agent. Acetic acid was then added to adjust the pH of the bath to four and one-half (4.5 pH). The amount of acetic acid added was four percent on the weight of the goods (4% O.W.G.), which in this particular example was a total of eight pounds (8 lbs). The vessel was then rotated at twelve revolutions per minute (12 rpm) for five minutes (5 min). To achieve a navy color, the following disperse dyes were then slowly added to the bath: 1.5160% O.W.G. of C.I. Disperse Blue 281, 0.3900% O.W.G. of C.I. Disperse Orange 30, and 0.1240% O.W.G. of Disperse Red 177. Also added to the dyebath was the soil release agent, ULTRACAP, also from Southeastern Chemical of Graham, N.C. The soil release agent enhanced the wickability of the polyester. While the vessel was being rotated at twelve revolutions per minute (12 rpm) the dye bath was indirectly heated at four degrees Fahrenheit per minute (4° F./min) at a constant volume until the bath reached a temperature of two hundred and sixty-five degrees Fahrenheit (265° F.) and the vessel reached a relative internal pressure of twenty-five pounds, per square inch (25 psi). This temperature was maintained for thirty minutes (30 min). The bath was then indirectly cooled to one hundred and sixty degrees Fahrenheit (160° F.) and drained. The vessel was then still filled with hot water at one hundred and sixty degrees Fahrenheit (160° F.) and a one percent on the weight of the goods (1% O.W.G.) scour solution was added to the bath. The textiles were agitated by rotation for five minutes and the bath was drained. The vessel was then still filled with hot water at one hundred and twenty degrees Fahrenheit (120° F.) and rotated at twelve revolutions per minute (12 rpm) for two minutes (2 min). The vessel was drained, filled with warm water at one hundred degrees Fahrenheit (100° F.), and then rotated at twelve revolutions per minute (12 rpm) for two minutes (2 min). The vessel was drained and the garments were removed from the machine and dried.

Conclusion

It should be understood that the described embodiments merely illustrate principles of the invention. Many modifications, additions and deletions may be made without departure from the description provided. For example, as described herein the elevated temperatures and pressures could be lower and be maintained for a longer period of time. Similarly the elevated temperatures and pressures could be higher and maintained for a shorter period of time. More importantly than any specific temperature or pressure cited in this description, the overall manner of temperature and pressure control described above facilitates an even, level dye strike, and the repeatability of the various temperatures and pressures is critical to repeating color matches. Also, for garments that are dyed merely to a light shade, there may be no need to dye the cotton component at all. In addition, as shown in FIG. 1, a reiterative process could be used to adjust color on test batches of textile that have undergone the custom dyeing process to ensure that the resulting color matched expectations.

Therefore, according to the present invention, custom-dyed textiles and methods for manufacturing such textiles can be accomplished to attain dimensional stability and durability and thereby withstand the rigors of commercial laundering facilities. In particular, the invention allows textiles to be dyed to custom colors in custom-sized batches after the labor intensive portion of the process is completed. Focusing technical resources in this manner yields textiles with outstanding colorfastness, pilling resistance, dimensional stability and durability. Additionally, it has been shown that the process of the invention yields textiles that may be overdyed to custom colors in custom-sized batches to extend the useful life of stained or otherwise discolored textiles. By performing the dyeing and overdyeing portions of the process at a location near the end user of the textile, transaction costs related to transportation of goods and maintenance of inventories can be minimized.

What is claimed and desired to be protected by Letters Patent is:

1. A process for overdyeing a previously-dyed, blended-fiber, knit garment, comprising the steps of:

acquiring a blended-fiber, knit garment that:

(a) has been manufactured to allow for shrinkage: (i) from vat dyeing at atmospheric pressure, and (ii) from disperse dyeing at temperatures and pressures above atmospheric conditions, and (b) has been previously vat-dyed at atmospheric pressure and disperse-dyed at temperatures and pressures above atmospheric conditions;

vat-dyeing the blended-fiber, knit garment at atmospheric pressure in a first bath; and disperse-dyeing the blended-fiber, knit garment at temperatures and pressures above atmospheric conditions in a second bath.

2. The process of claim 1 wherein the garment of the manufacturing step is made from a blend of cellulosic fibers and polyester fibers.

3. The process of claim 2 wherein:

the vat dyeing step is performed by placing the garment in the first bath, adding a caustic agent to the first bath, adding at least one vat dye to the first bath for dyeing the cellulosic fibers of the garment, adding a reducing agent to the first bath and adding an oxidizing agent to the bath; and the disperse dyeing step is performed by placing the garment in the second bath, adding an acidic agent to the second bath, adding a soil-release agent to the second bath, adding at least one disperse dye to the second bath for dyeing the polyester fibers of the garment, and heating the bath to temperatures and pressures above atmospheric conditions.

4. The process of claim 3 wherein the temperatures of the disperse dyeing step are up to 265° F. and the pressures of the disperse dyeing step are up to 25 psi.

5. The process of claim 3 wherein cellulosic fibers of the blended-fiber, knit garment of the manufacturing step are cotton.

* * * * *

UNITED STATES PATENT AND TRADEMARK OFFICE

CERTIFICATE OF CORRECTION

PATENT NO. : 6,068,666

DATED : May 30, 2000

INVENTOR(S) : Robert Amick and James L. Brebner

It is certified that error appears in the above-identified patent and that said Letters Patent is hereby corrected as shown below:

On the title page, at page 1, "Over Dyeing", should be --OVERDYEING--

At column 2, line 43, "yam" should be --yarn--

At column 6, line 52, "(40° F/min)" should be --(4° F/min)--

At column 7, line 61, "thepH" should be --the pH--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*